United States Patent [19]

Killmeyer

[11] Patent Number: 4,936,704

[45] Date of Patent: Jun. 26, 1990

[54] EXPANSION JOINT FILLER STRIP HOLDER

[76] Inventor: Gary M. Killmeyer, 101 Maplewood Dr., Pittsburgh, Pa. 15214

[21] Appl. No.: 260,251

[22] Filed: Oct. 20, 1988

[51] Int. Cl.[5] ..... E01C 11/06; E01C 11/12

[52] U.S. Cl. ..... 404/74; 404/87; 404/68

[58] Field of Search ..... 404/87, 74, 48, 55, 404/47, 68; 249/9, 2, 3; 52/699

[56] References Cited

U.S. PATENT DOCUMENTS

| | | | |
|---|---|---|---|
| Re. 24,172 | 6/1956 | Brickman | 401/63 |
| 1,017,346 | 2/1912 | Thomas | 404/47 |
| 1,092,848 | 4/1914 | Moyer | 404/56 |
| 1,195,368 | 8/1916 | Laing | 404/68 |
| 1,241,826 | 10/1917 | Davis | 404/47 |
| 1,516,100 | 11/1924 | Hubbard | 404/87 |
| 1,615,651 | 1/1927 | Reynolds et al. | 52/687 |
| 2,117,549 | 5/1938 | Dunn | 404/70 |
| 2,291,157 | 7/1942 | Hillberg | 404/63 |
| 2,864,289 | 12/1958 | De Canio | 404/62 |
| 3,385,017 | 5/1968 | Williams | 404/68 X |
| 4,198,176 | 4/1980 | Bentz | 404/68 |

*Primary Examiner*—Hoang C. Dang
*Assistant Examiner*—Matthew Smith
*Attorney, Agent, or Firm*—Walter J. Blenko, Jr.; David V. Radack

[57] ABSTRACT

An expansion joint filler strip holder and an associated method are disclosed. The device consists of a ground engaging member to which a filler strip holder is attached. In one embodiment, the filler strip holder consists of two parallel rails to which are attached a plurality of material supports. In another embodiment the rails are formed to provide a plurality of material support portions. The method involves providing the device and placing it in the ground by using the ground engaging members and then placing filler paper between the rails and material supports or portions. After this, concrete is poured over the device and around the filler paper to form an expansion gap between adjacent concrete areas.

10 Claims, 3 Drawing Sheets

63
73
62
72
90
69
91
61
71
90
91
60
70

73
87
63
86
72
85
62
84
69
91
90
71
61
83
82
70
81
60
80

90
63
73
86
69
91
87
87
63
69
62
85
91
61
83
81
60

EXPANSION JOINT FILLER STRIP HOLDER

This invention relates to an expansion joint filler paper holder for construction of concrete pavements and the like. More particularly, this invention relates to a holder for positioning a paper mat between abutting concrete slabs in a pavement.

It is well known to provide a space between adjacent concrete slabs in a pavement to allow expansion and contraction of the concrete. This space, called an expansion joint or gap, prevents the adjacent areas of concrete from rubbing against each other. This joint is usually filled by resilient filler strip made of paper, rubber, or other materials.

It is also known to provide expansion joint filler devices having dowel rods which engage the filler material. The dowel rods may be supported by "chair assemblies" which are mounted to support rods. The dowel bars in concert with the chair assemblies and support rods allow a joint filler strip to be placed in an upstanding position. Concrete is then poured over the devices and on either side of the filler strip. Thus, the device becomes a permanent part of the concrete deck. See, for example, U.S. Pat. Nos. 2,291,157, 2,864,289, and Re 24,172.

U.S. Pat. No. 1,195,368 discloses an expansion joint consisting of a clamp and a support. The clamp is formed so that a filler material may be interposed therebetween. The filler material is held in place by a pair of tongues on either side of the filler material which are secured by bolts or rivets.

A known method of providing a filler strip between adjacent areas of concrete involves the steps of providing two by four pieces of wood to form areas into which alternate slabs of concrete are poured, the filler strip is then placed adjacent the poured slabs and concrete is poured into the areas between.

I provide a holder for a filler strip in an expansion joint consisting of a plurality of ground engaging members attached to a filler strip holder means. I further provide that the filler strip holder means include two spaced apart elongated rails which hold the filler strip in position. I further preferably provide that the concrete areas are formed on either side of the filler strip so that an expansion joint with a filler strip is formed between the two concrete areas.

I also provide an associated method of placing a filler strip in an expansion joint between adjacent concrete areas. The method comprises the steps of providing the holder device described above, placing the ground engaging members in the ground where the filler strip is desired to be located, placing the filler strip in the holder device and pouring concrete on either side of the filler strip. The method provides an expansion joint having a filler strip between adjacent concrete areas.

Other details, objects, and advantages of my invention will become more apparent as the following description of a present preferred embodiment thereof proceeds.

In the accompanying drawings, I have illustrated a present preferred embodiment of my invention, in which.

Figure 1:
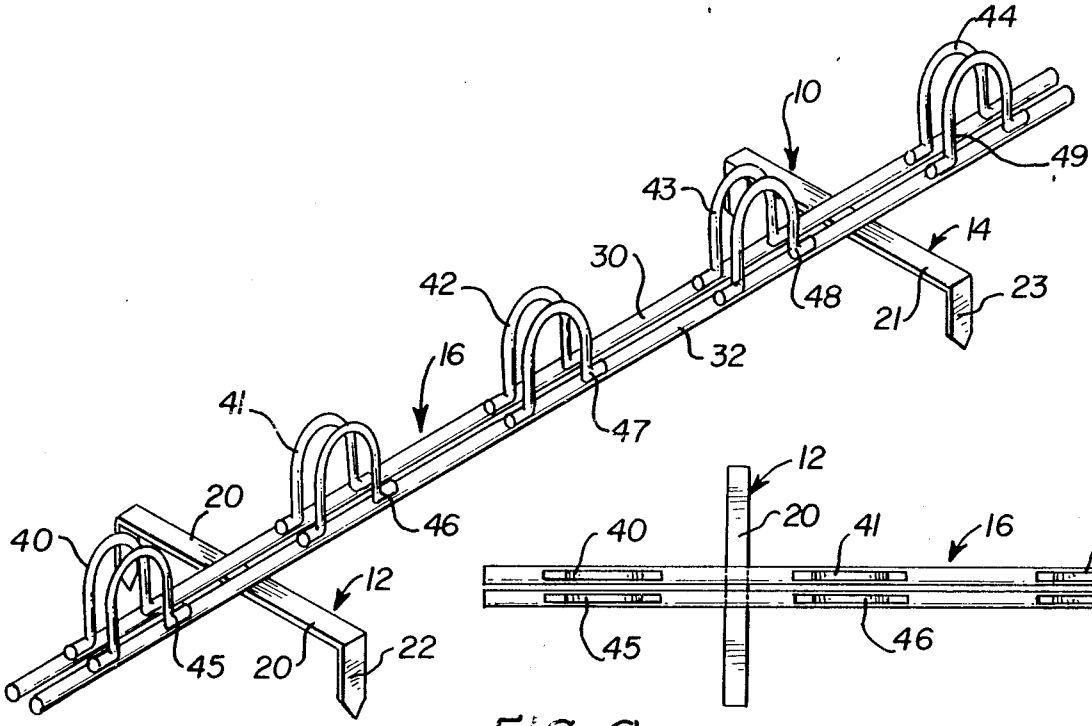
FIG. 1 is a perspective view of a preferred embodiment of the expansion joint filler paper device.
Figure 2:
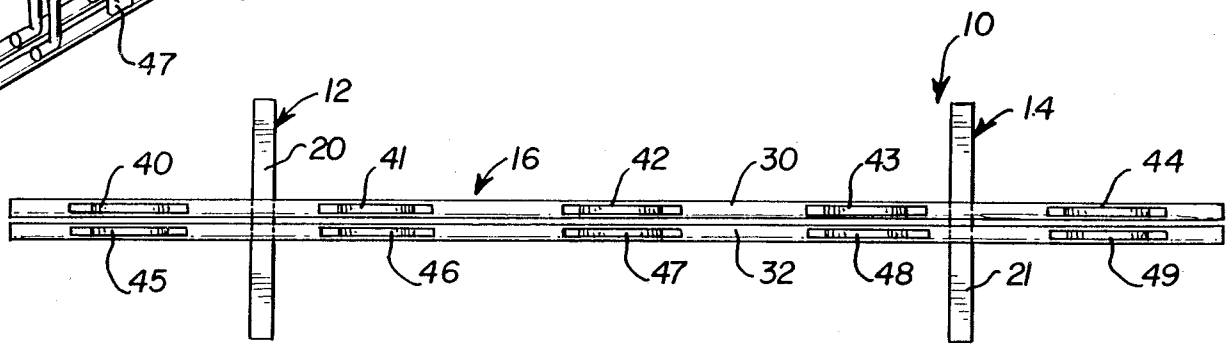
FIG. 2 is a top plan view of the device shown in FIG. 1.
Figure 3:
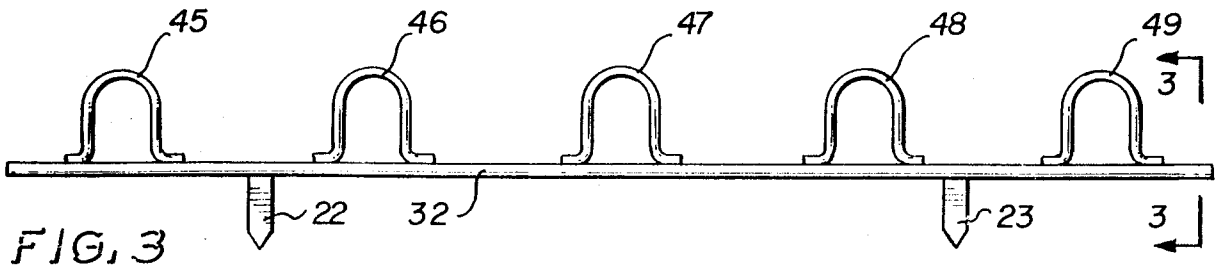
FIG. 3 is a left side view of the device shown in FIG. 1.
Figure 4:
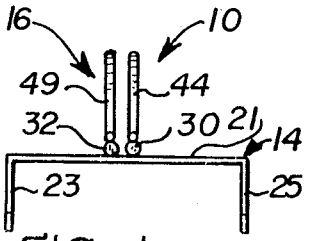
FIG. 4 is a front elevational view along line 4—4 of FIG. 3 of the device shown in FIG. 1.
Figures 5, 6, 7, 8:
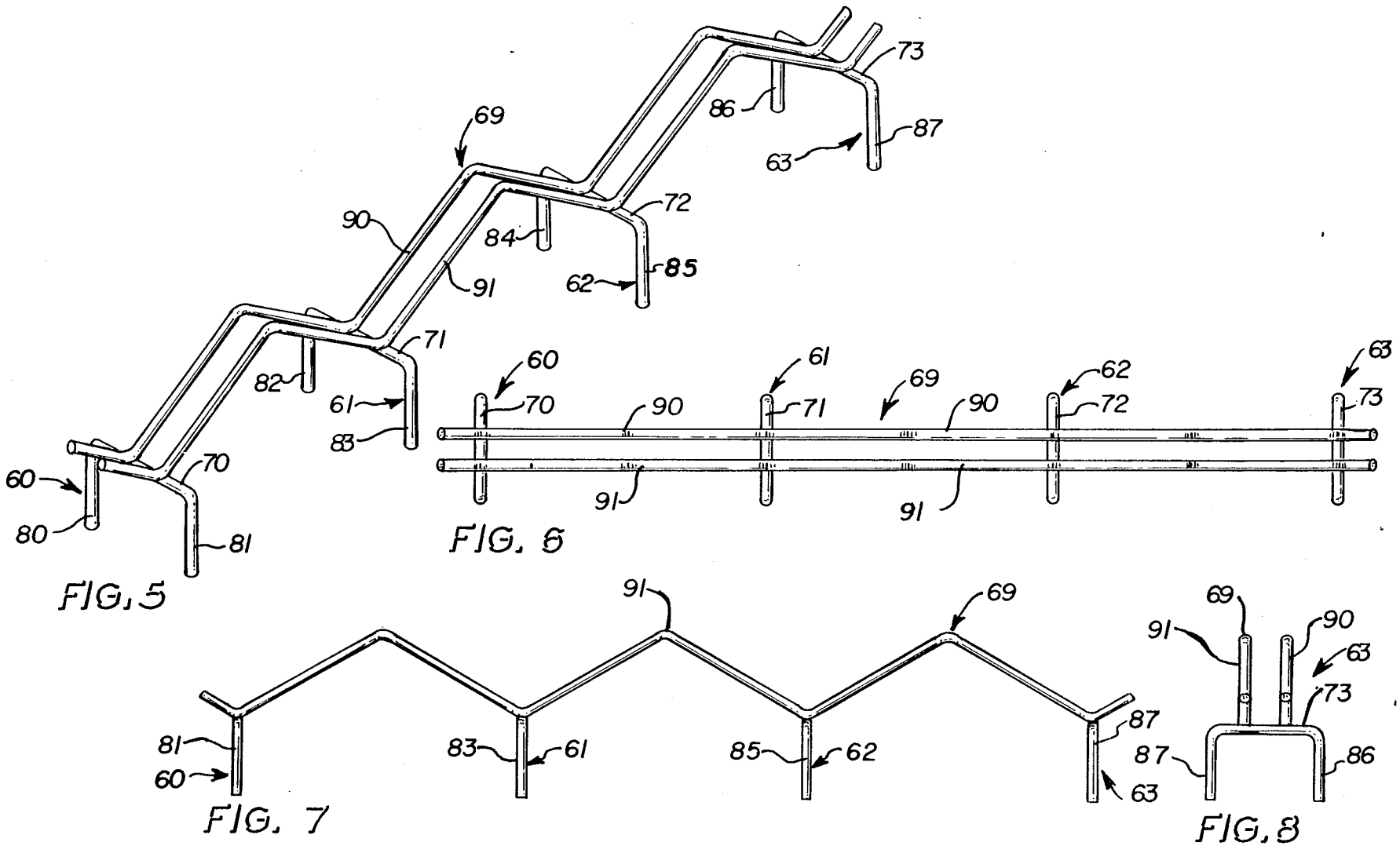
FIG. 5 is a perspective view of another preferred embodiment of the expansion joint filler paper device.
FIG. 6 is a top plan view of the device shown in FIG. 5.
FIG. 7 is a left side view of the device shown in FIG. 5.
FIG. 8 is a front elevational view along line 8—8 of FIG. 7.

Referring more particularly to FIGS. 1–4, the expansion joint filler paper device 10 consists of two ground engaging members 12 and 14, and a filler strip holder 16. The ground engaging members 12 and 14 have a flat horizontal bar 20 and 21 with two downwardly depending legs 22, 23, and 24, 25. The legs 22 and 24 preferably taper to an edge to facilitate placing the ground engaging members 12 and 14 into the ground.

The filler strip holder 16 consists of two spaced apart elongated rails 30 and 32 which are attached as by welding to the flat horizontal bars 20 and 21 of each ground engaging member. The length of the rails 30 and 32 can vary to suit different job applications. Also, the distance "d" between the rails 30 and 32 can vary depending on the thickness of the expansion joint paper filler (not shown here).

A plurality of material supports 40–49 are attached to respective rails 30 and 32. The material supports 40–49 are preferably welded to the rails 30 and 32 in such a way as to be in a parallel side-by-side relationship to the opposite material support. That is, material support 40 is welded onto rail means 30 so as to be in a side-by-side parallel relationship with material support 45 which is welded onto rail 32.

Any number of pairs of material supports can be welded onto each rail according to the length of the rail and the support desired or needed for the expansion joint filler paper. The device need not have straight rail, but can be of any shape or orientation. The various parts of the device may be constructed out of materials selected from the group consisting of steel, aluminum, plastics, and other synthetic materials.

Another embodiment of the device is shown in FIGS. 5–18. The device, as shown, has four ground engaging members 60, 61, 62, and 63 and a filler strip holder 69. The ground engaging members 60–63 again have flat bases 70, 71, 72, and 73 and each have two downwardly depending legs 80, 81, and 82, 83 and 84, 85, and 86, 87 respectively. The legs are preferably tapered in order to facilitate placing the ground engaging members 60–63 into the ground.

The filler strip holder 69 consists of two spaced apart rails 90 and 91 which are bent and formed to provide raised side-by-side material support portions. The material support portions are in side-by-side parallel relationship with the opposite material support portions. Any number of pairs of material support portions can be provided for each rail according to the length of the rail and the support desired or needed for the expansion joint filler paper.

The apparatus is used by providing the expansion joint filler paper device as described above and positioning and placing it in the ground by means of the ground engaging members at the point where it is desired to create an expansion joint. After this, a filler paper strip is placed in the filler strip holder of the device by putting it in between the rail so as to be supported by the material support. Concrete is then poured into the desired areas. The concrete is poured over the device, but adjacent areas are separated by the filler paper.

Figure 9:
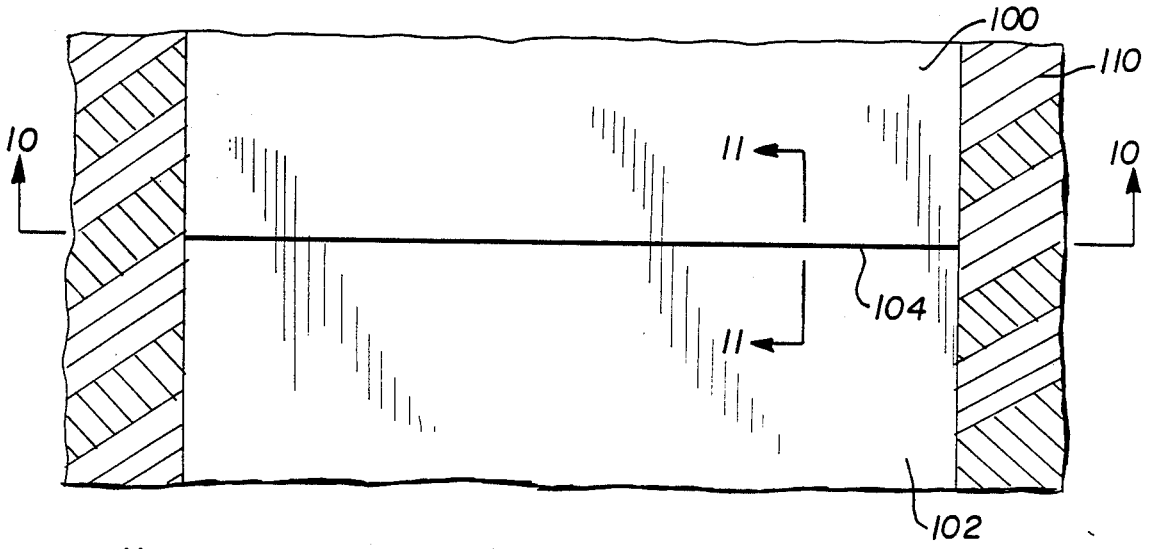
FIG. 9 is a top plan view showing the device in use between two adjacent areas of concrete.
Figure 10:
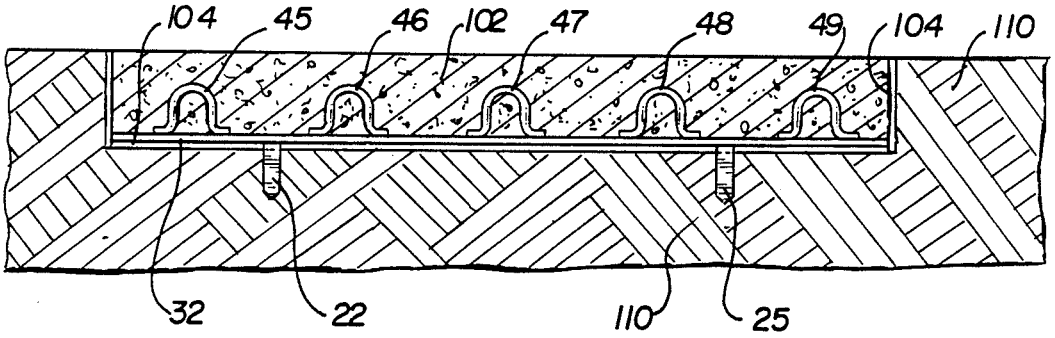
FIG. 10 is a cross-sectional view taken along line 10—10 of FIG. 9.
Figure 11:
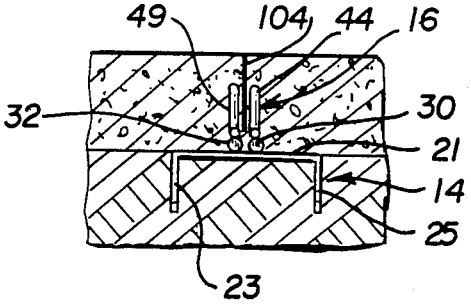
FIG. 11 is a cross-sectional view taken along line 11—11 of FIG. 10.

The finished adjacent concrete areas are shown in FIGS. 9–11. As can be seen, adjacent concrete areas 100 and 102 are separated by expansion paper 104. The expansion paper 104 is placed in the filler strip holder 16 by placing it in between the material supports 40–44. The expansion paper 104 preferably extends beyond the top of the material supports 40–44. The ground engaging members 12 and 14 are totally buried in the ground 110.

The expansion joint filler paper holder device is easy to use and manufacture and provides for any easy method to pour concrete so as to form an expansion joint between adjacent areas of concrete.

While I have illustrated and described a present preferred embodiment of my invention, it is to be understood that the invention is not limited thereto and may be otherwise variously practiced within the scope of the following claims.

I claim:

1. A device for holding a filler strip to form an expansion gap between two adjacent concrete areas, said device comprising:

a plurality of ground engaging members and a filler strip holder means having two spaced apart elongated rail means, said rail means each attached separately to said ground engaging members and said ground engaging members and said rail means forming a unitary structure adapted to receive said filler strip which is inserted in the space between said two rails and to hold said filler strip with a portion of said filler strip projecting above said filler strip holder means, whereby said filler strip is positioned between said rail means and said concrete areas are formed on either side of said filler strip so than an expansion joint with a filler strip is formed between said concrete areas.

2. The device of claim 1, including said ground engaging members and said filler strip holder means being made of materials selected from the group consisting of steel, aluminum, plastic, and synthetic materials.

3. A device for holding a filler strip to form an expansion gap between two adjacent concrete areas, said device comprising:

a plurality of ground engaging members, a filler strip holder means having two spaced apart elongated rail means attached to said ground engaging members forming a unitary structure adapted to receive said filler strip which is inserted in the space between said two rails and to hold said filler strip with a portion of said filelr strip projecting above said filler strip holder means, whereby said filler strip is positioned between said rail means and said concrete areas are formed on either side of said filler strip so that an expansion joint with a filler strip is formed between said concrete areas, and said ground engaging members having a horizontal bar to which said rail means are attached and at least one downwardly depending leg means, whereby facilitation of placing said device into the ground is accomplished.

4. The device of claim 3, including said rail means include material support means attached thereto, whereby said filler strip can be positioned in between said material support means.

5. A device for holding a filler strip which is positioned between two adjacent concrete areas formed on either side of the filler strip so that an expansion gap with a filler strip is formed between said concrete areas, said device comprising:

a plurality of ground engaging members, a filler strip holder means having two spaced apart elongated rail means attached to said ground engaging members, whereby said filler strip is positioned between said rail means and said concrete areas are formed on either side of said filler strip so that an expansion joint with a filler strip is formed between said concrete areas, said ground engaging members and said filler strip holder means being made of materials selected from the group consisting of steel, aluminum, plastic, and synthetic materials, said ground engaging member having a horizontal bar to which said rail means are attached and at least one downwardly depending leg means, whereby facilitation of placing said device into the ground is accomplished, said rail means include material support means attached thereto, whereby said filler strip can be positioned in between said material support means, and said first rail means having a plurality of said material support means and said second rail means having a plurality of said material support means.

6. The device of claim 5, including each said first rail material support means being positioned in a side-by-side parallel relationship with each said second rail material support means.

7. The device of claim 3, including said rail means being shaped so as to form material support portions, whereby said filler strip can be positioned in between said material support portions.

8. A device for holding a filler strip which is positioned between two adjacent concrete areas formed on either side of the filler strip so that an expansion gap with a filler strip is formed between said concrete areas, said device comprising:

a plurality of ground engaging members, a filler strip holder means having two spaced apart elongated rail means attached to said ground engaging members, whereby said filler strip is positioned between said rail means and said concrete areas are formed on either side of said filler strip so that an expansion joint with a filler strip is formed between said concrete areas, said ground engaging members and said filler strip holder means being made of materials selected from the group consisting of steel, aluminum, plastic, and synthetic materials, said ground engaging member having a horizontal bar to which said rail means are attached and at least one downwardly depending leg means, whereby facilitation of placing said device into the ground is accomplished, said rail means being shaped so as to form material support portions, whereby said filler strip can be positioned in between said material support portions, and said first rail means having a plurality of material support portions and said second rail means having a plurality of said material support portions.

9. The device of claim 8, including each said first rail material support portion being positioned in a side-by-side parallel relationship with each said second rail material support portion.

10. A method of placing a filler strip in an expansion joint between adjacent concrete areas comprising the steps of providing a filler strip holder device including a plurality of ground engaging members attached to a filler strip holder means having two spaced apart elongated rail means each separately attached to said ground engaging members, said rail means and said ground engaging members forming a unitary structure and said device being adapted to receive a filler strip, placing the ground engaging members in contact with the ground where said filler strip is desired to be located, placing said filler strip in the space between said two rails of said filler strip holder means so that a portion of said filler strip projects above said filler strip holder means, and pouring concrete on either side of said filler strip, whereby said expansion joint having said filler strip is formed between said adjacent concrete areas.

* * * * *

UNITED STATES PATENT AND TRADEMARK OFFICE

CERTIFICATE OF CORRECTION

PATENT NO. : 4,936,704

DATED : June 26, 1990

INVENTOR(S) : Gary M. Killmeyer

It is certified that error appears in the above-identified patent and that said Letters Patent is hereby corrected as shown below:

In the title page, under References Cited, change Class for Brickman Patent Re. 24,172 from "401/63" to --404/63--.

Column 2, line 52, change "5-18" to --5-8--.

Column 3, line 46, change "than" to --that--; line 62, change "filelr" to --filler--.

Signed and Sealed this

Twenty-fifth Day of June, 1991

*Attest:*

*Attesting Officer*

HARRY F. MANBECK, JR.

*Commissioner of Patents and Trademarks*